US005425247A

United States Patent [19]

Hatano

[11] Patent Number: 5,425,247

[45] Date of Patent: Jun. 20, 1995

[54] WIND DIRECTION ALTERATION DEVICE FOR USE IN AIR CONDITIONING APPARATUS

[75] Inventor: Koji Hatano, Kusatsu, Japan

[73] Assignee: Matsushita Electric Industrial Co., Ltd., Osaka, Japan

[21] Appl. No.: 141,594

[22] Filed: Oct. 27, 1993

[30] Foreign Application Priority Data

Oct. 29, 1992 [JP] Japan ..... 4-291058

[51] Int. Cl.[6] ..... F25D 23/12

[52] U.S. Cl. ..... 62/262; 74/43; 454/285

[58] Field of Search ..... 403/353, 59, 61; 74/42, 74/43; 62/262; 454/153, 202, 285

[56] References Cited

U.S. PATENT DOCUMENTS

| | | | |
|---|---|---|---|
| 604,896 | 5/1898 | Garnett | 403/353 X |
| 1,804,420 | 5/1931 | Kelley | 403/353 X |
| 3,139,295 | 6/1964 | Hosea | 403/61 |
| 4,225,265 | 9/1980 | Hooker et al. | 403/353 |
| 4,777,870 | 10/1988 | Bolton et al. | 74/43 X |
| 4,813,345 | 3/1989 | Kobayashi et al. | 74/42 X |
| 4,898,083 | 2/1990 | Jones | 403/353 X |

*Primary Examiner*—William E. Tapolcai
*Attorney, Agent, or Firm*—Wenderoth, Lind & Ponack

[57] ABSTRACT

A wind direction alteration device for use in an integral type air conditioning apparatus in which the diameter of a connecting shaft of a blade extending through an opening formed in a connecting rod is greater than that of the shaft above and below the opening. The opening of the connecting rod is elongated and constricted in the center thereof. Three or more projections are extending into the opening through which the connecting shaft penetrates. A portion, holding the connecting rod, formed on a shaft of a wind direction alteration motor is disposed beyond a vertical movable range of the connecting rod. A portion, of the connecting rod, which is in contact with the portion of the shaft holding the connecting rod is inclined. A rib is formed on the inner surface of the elongated opening, of the connecting rod, through which the shaft of the wind direction alteration motor penetrates such that the rib is parallel with the direction in which the elongated opening is formed.

12 Claims, 6 Drawing Sheets

*Fig. 7* - PRIOR ART
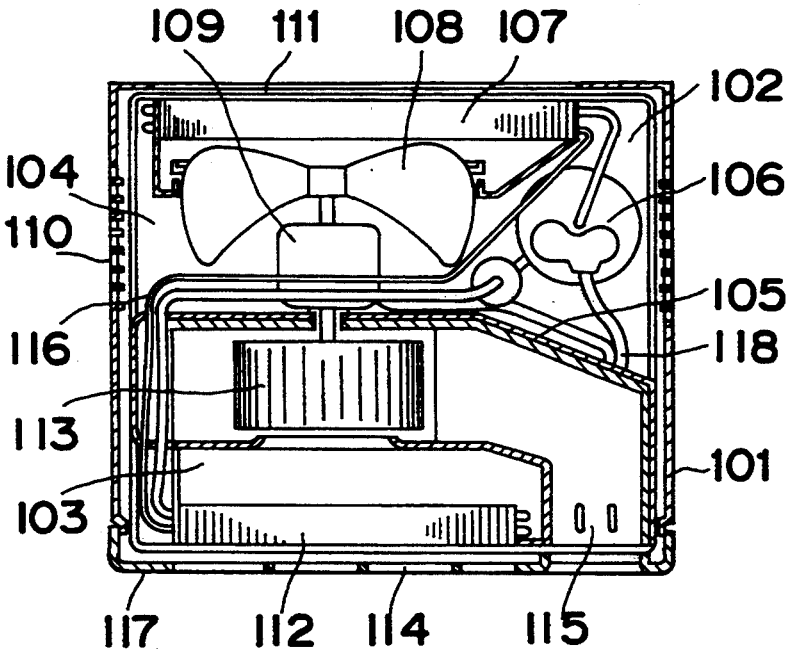

*Fig. 8* - PRIOR ART
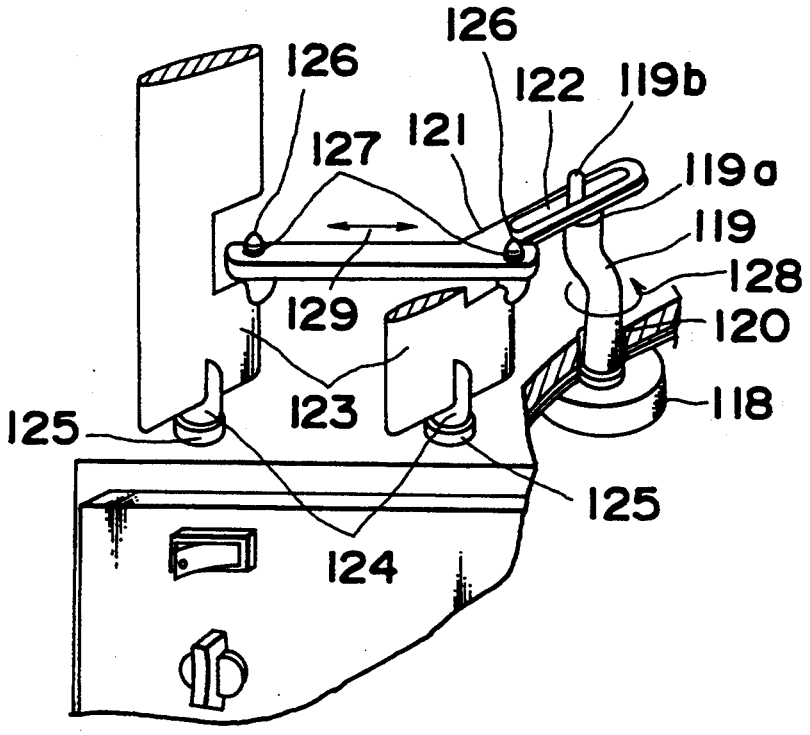

WIND DIRECTION ALTERATION DEVICE FOR USE IN AIR CONDITIONING APPARATUS

BACKGROUND OF THE INVENTION

1. Field of the Invention

The present invention relates to a wind direction alteration device for use in an integral type air conditioning apparatus.

2. Description of the Related Arts

The construction of a main body of a conventional integral type air conditioning apparatus is described below with reference to FIGS. 7 and 8. The main body of the air conditioning apparatus comprises an outer casing 101 and a base plate 102 removably accommodated in the outer casing 101. A partitioning plate 105 partitioning the inside of the main body of the air conditioning apparatus into an indoor side 103 and an outdoor side 104 is installed on the base plate 102. The outdoor side 104 comprises a compressor 106; an outdoor heat exchanger 107; an outdoor fan 108; a fan motor 109 for driving the outdoor fan 108; an outdoor inlet 110 which is opened on the outdoor side 104; an outdoor outlet 111; and an outdoor ventilation circuit. The indoor side 103 comprises an indoor heat exchanger 112; an indoor fan 113 installed on the fan motor 109 and driven thereby; an indoor inlet 114 which is opened on the indoor side 103; an indoor outlet 115; an indoor ventilation circuit accommodating the indoor heat exchanger 112 and the indoor fan 113. A refrigerant cycle is constituted by the compressor 106; the outdoor heat exchanger 107; a decompression device 116; and the indoor heat exchanger 112 connected to each other sequentially. The base plate 102 is inserted into the outer casing 101 in the direction from the front thereof, namely, in the direction from the indoor side and then, a front grill 117 is fixed to the main body.

A wind direction alteration device is described below referring to FIG. 8. A crank-shaped shaft extending from a wind direction alteration motor 118 disposed outside the indoor outlet 115 extends through an opening 120 formed at the indoor outlet 115, thus being guided through the indoor outlet 115. The thickness of the leading end portion thereof is set to be smaller than that of other portions thereof by stepping the shaft 119 in the vicinity of the leading end portion thereof. The upper end **119*a* of the thick portion of the shaft 119 is flat and holds a connecting rod 121. The narrow shaft 119*b* disposed upward from the upper end of the shaft 119 penetrates through an elongated opening 122 formed in the connecting rod 121. A pair of shafts 124 (upper portions of the shafts 124 are not shown in FIG. 8) disposed at a lower end of each blade 123 are held by bearings 125 (upper portions of the bearings 125 are not shown in FIG. 8) provided above and below the indoor outlet 115. In this manner, the blades 123 are disposed above and below the indoor outlet 115 and are rotatable on the shafts 124. A pair of connecting shafts 126 connecting each blade 123 and the connecting rod 121 to each other is formed on the blade 123. Openings 127 through which the connecting shafts 126 of the blades 123 penetrate are formed at a front portion of the connecting rod 121. The front portion of the connecting rod 121 is held by the connecting shafts 126 extending through the openings 127, and the rear portion thereof is held by the upper end 119*a* of the thick portion of the shaft 119. In this manner, the wind direction alteration device is constituted by the wind direction alteration motor 118, the connecting rod 121, and the blade 123. With the rotation (shown by an arrow) of the shaft 119, the end portion 119*b* of the shaft 119 reciprocates along the elongated opening 122 of the connecting rod 121 with the connecting rod 121 reciprocating crosswise as shown by an arrow 129. Then, the blade 123 makes a reciprocating motion crosswise with the blade 123 rotating on the shaft 124**.

The wind direction alteration device has, however, a large clearance in the sliding-contact portion and is disposed in the ventilation circuit. Therefore, the connecting rod is shaken by wind, thus generating chatter.

SUMMARY OF THE INVENTION

It is an object of the present invention to provide a wind direction alteration device, for use in an integral type air conditioning apparatus, in which has a simple construction and yet prevents chatter from being generated.

In accomplishing these and other objects, there is provided a wind direction alteration device, for use in an integral type air conditioning apparatus in which the diameter of a connecting shaft of a blade penetrating through an opening formed in a connecting rod is greater than that of the opening in a range above and below the opening.

The opening of the connecting rod is elongated and constricted in the center thereof.

Three or more projections are formed on the opening through which the connecting shaft penetrates. A portion, holding the connecting rod, formed on a shaft of a wind direction alteration motor is disposed beyond a vertical movable range of the connecting rod.

A portion, of the connecting rod, in contact with the portion of the shaft which holds the connecting rod is inclined.

A rib is formed on the inner surface of the elongated opening, of the connecting rod, through which the shaft of the wind direction alteration motor extends, such that the rib is parallel with the direction in which the elongated opening is formed.

According to one aspect of the present invention, the connecting rod is sandwiched between upper and lower portions of the connecting shaft. In this manner, the connecting rod can be prevented from being shaken vertically.

According to another aspect of the present invention, the connecting shaft of the blade extends through one of the circular portions of the elongated opening and then, moved to the other circular portion thereof so that the connecting rod is sandwiched between the upper and lower portions of the connecting shaft.

According to still another aspect of the present invention, the contact area between the connecting rod and the connecting shaft is very small.

According to a further aspect of the present invention, shearing load is applied to the connecting rod.

According to a still further aspect of the present invention, a constant shearing load is applied to the connecting rod.

According to another aspect of the present invention, the formation of the rib reduces the contact area between the connecting rod and the connecting shaft.

BRIEF DESCRIPTION OF THE DRAWINGS

These and other objects and features of the present invention will become clear from the following description taken in conjunction with the preferred embodiments thereof with reference to the accompanying drawings, in which:

FIG. 7 is a transverse front view showing a conventional air conditioning apparatus of integral type;

FIG. 8 is a perspective view showing principal portions of a wind direction alteration device of the integral type air conditioning apparatus of FIG. 7.

DETAILED DESCRIPTION OF THE INVENTION

Figure 1A:
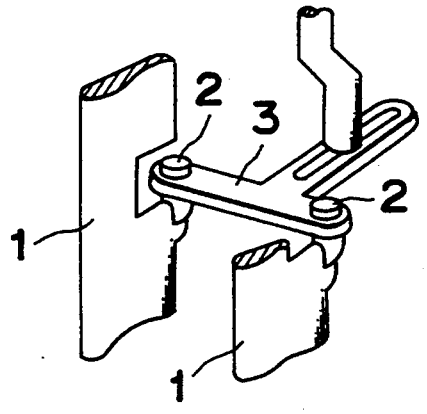
FIG. 1*a* is a perspective view showing principal portions of a wind direction alteration device for use in an integral type air conditioning apparatus according to an embodiment of the present invention.

Before the description of the present invention proceeds, it is to be noted that like parts are designated by like reference numerals throughout the accompanying drawings.

An integral type air conditioning apparatus according to an embodiment of the present invention is described below with reference to FIGS. 1 through 6.

The construction of the main body of the integral type air conditioning apparatus is the same as that of the conventional integral type air conditioning apparatus. Therefore, the description of the construction of the main body of the integral type air conditioning apparatus is omitted herein.

Figure 1B:
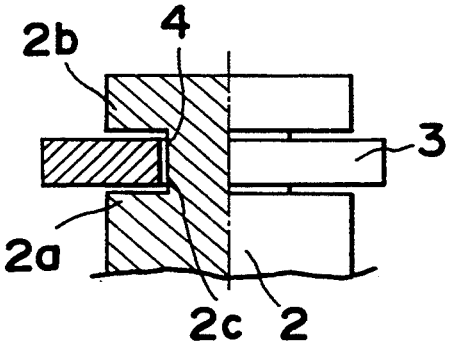
FIG. 1*b* is a side view partly in vertical section showing principal portions of the wind direction alteration device of FIG. 1*a;*
Figure 2:
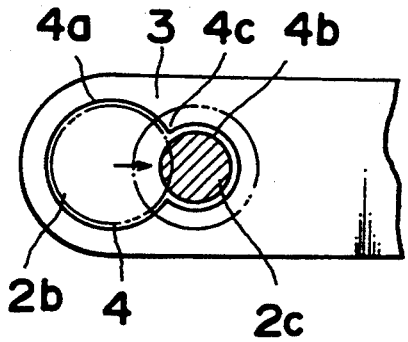
FIG. 2 is a front view showing principal portions of the wind direction alteration device of FIG. 1*a;*

Referring to FIGS. 1 and 2, above and below a connecting opening 4 formed in a connecting rod 3, a connecting shaft 2 formed on a blade 1 has a receiving portion 2*a* and a pressing portion 2*b*, the diameters of which are larger than that of the connecting opening 4, respectively. The vertical movement of the connecting rod 3 is regulated by the receiving portion 2*a* and the pressing portion 2*b* when the connecting rod 3 is connected with the blade 1. Accordingly, a wind direction alteration motor (not shown) may be disposed above a wind direction alteration device.

Referring to FIG. 2 showing a method for connecting portions, the connecting opening 4 formed in the connecting rod 3 comprises an insertion portion 4*a*; a sliding-contact portion 4*b*; and a constricted portion 4*c*. The diameter of the insertion portion 4*a* is greater than that of the pressing portion 2*b* of the blade 1. The diameter of the sliding-contact portion 4*b* is smaller than that of the receiving portion 2*a* and the pressing portion 2*b* of the blade 1. The diameter of the constricted portion 4*c* is smaller than that of a sliding-contact portion 2*c* of the connecting shaft 2. The pressing portion 2*b* of the connecting shaft 2 is penetrated through the insertion portion 4*a* and then, moved to the sliding portion 4*b*. The diameter of the constricted portion 4*c* is smaller than that of the sliding-contact portion 2*c* of the connecting shaft 2. Therefore, in connecting the connecting portions, the constricted portion 4*c* is expanded by utilizing the elastic force of the connecting rod 3. After the connecting portions are connected to each other, the constricted portion 4*c* is not removed from the sliding-contact portion 2*c* because the diameter of the constricted portion 4*c* is smaller than that of the sliding-contact portion 2*c*.

Figure 3A:
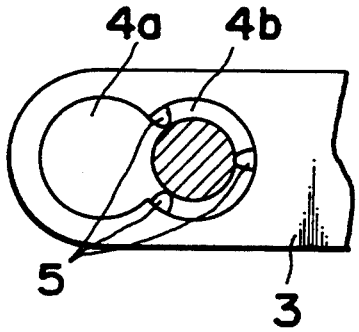
FIG. 3*a* is a front view showing principal portions of the wind direction alteration device of FIG. 1*a;*
Figure 3B:
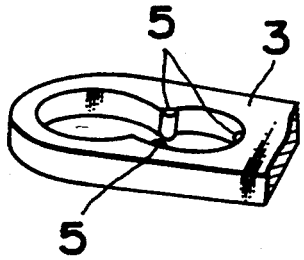
FIG. 3*b* is a perspective view showing principal portions of the wind direction alteration device of FIG. 1*a;*

Referring to FIGS. 3*a* and 3*b* showing the wind direction alteration device, projections 5 are formed to project into the sliding-contact portion 4*b* of the connecting opening 4 formed in the connecting rod 3. The sliding-contact portion 2*c* of the connecting shaft 2 is brought into contact with the sliding-contact portion 4*b* of the connecting opening 4 at only the peripheral portions of the projections 5. Therefore, the contact area between the connecting rod 3 and the connecting shaft 2 is very small and thus frictional resistance of the projections 5 to the sliding-contact portion 2*c* is small. As a result, the clearance between the sliding-contact portions 4*b* and 2*c* is made to be almost zero. Accordingly, generation of chatter can be prevented.

Figure 4:
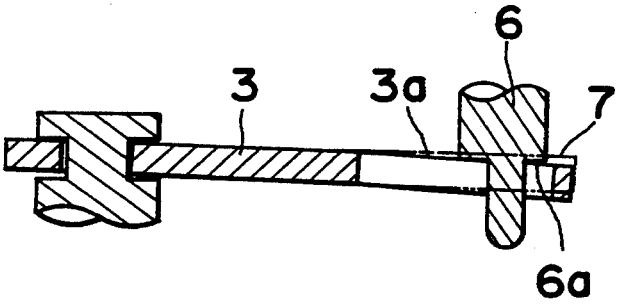
FIG. 4 is a side view partly in vertical section showing principal portions of the wind direction alteration device of FIG. 1*a;*

FIG. 4 shows the relationship between the position of the connecting rod 3 and that of a shaft 6 of the wind direction alteration motor (not shown). In this embodiment, a pressing portion 6*a* of the shaft 6 is disposed below a downward movable range 7 (shown by two-dot chain line) of the connecting rod 3. Consequently, shearing load is applied to the connecting rod 3 which is thus flexed downward. Due to the elastic force of the connecting rod 3, no clearance is generated between the upper surface 3*a* of the connecting rod 3 and the pressing portion 6*a* of the shaft 6.

Figure 5A:
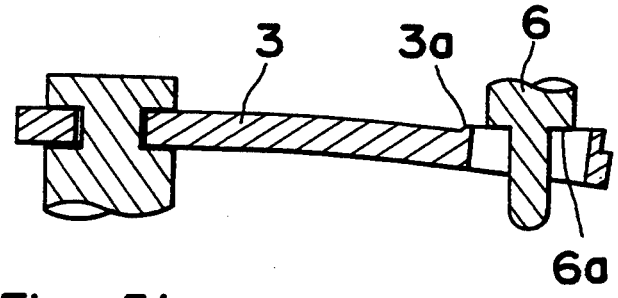
FIG. 5*a* is a side view partly in vertical section showing principal portions of the wind direction alteration device of FIG. 1*a;*
Figure 5B:
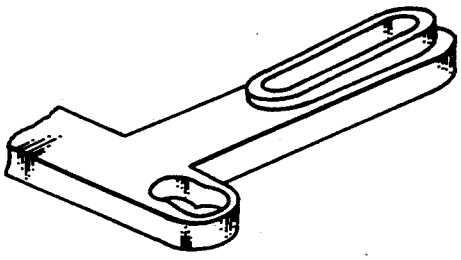
FIG. 5*b* is a perspective view showing principal portions of the wind direction alteration device of FIG. 1*a;*

FIGS. 5*a* and 5*b* show the wind direction alteration device in which the upper surface 3*a* of the connecting rod 3 to be brought in contact with the pressing portion 6*a* of the shaft 6 is inclined. As shown in FIG. 4, the pressing portion 6*a* of the shaft 6 of the wind direction alteration motor is disposed below the downward movable range 7 (two-dot chain line) of the connecting rod 3 as described above. With the rotation of the wind direction alteration motor, the shaft 6 moves crosswise in FIG. 5. Therefore, the inclination of the upper surface 3*a* of the connecting rod 3 allows the connecting rod 3 to be flexed downward by a constant distance. In this manner, unbalanced abrasion can be prevented.

Figure 6A:
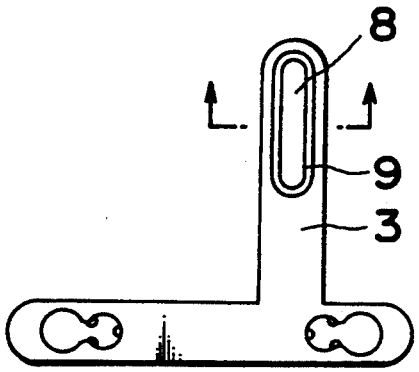
FIG. 6*a* is a front view showing principal portions of the wind direction alteration device of FIG. 1*a;*
Figure 6B:
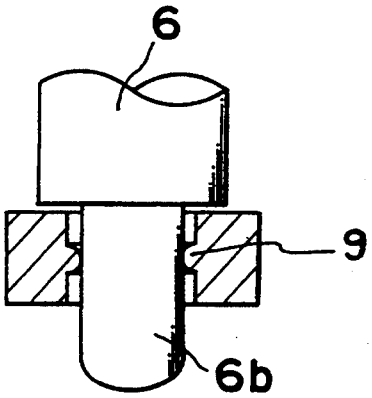
FIG. 6*b* is a side view partly in vertical section showing principal portions of the wind direction alteration device of FIG. 1*a;*

FIGS. 6*a* and 6*b* show the configuration of an elongated opening 8, formed on the connecting rod 3, for use in the wind direction alteration motor. A rib 9 is formed in parallel with the elongated opening 8. In this construction, only the leading end of the rib 9 contacts the sliding-contact portion 6*b* of the shaft 6 in a very small area. Therefore, frictional resistance is small. As a result, the clearance between the sliding-contact portions 6*b* and 2*c* is made to be almost zero. Accordingly, generation of chatter can be prevented.

As apparent from the foregoing description of the present invention, the wind direction alteration device comprising the wind direction alteration motor, the blade, and the connecting rod has a simple construction and yet the engaging portion between component parts can be prevented from being shaken. Thus, the generation of chatter can be prevented.

Although the present invention has been fully described in connection with the preferred embodiments thereof with reference to the accompanying drawings, it is to be noted that various changes and modifications will be apparent to those skilled in the art. Such changes and modifications will be to be understood as included within the scope of the present invention as defined by the appended claims unless they depart therefrom.

What is claimed is:

1. A wind direction alteration device for use in an integral type air conditioning apparatus comprising an outer casing, a base plate removably accommodated in the outer casing, a partitioning plate mounted on the base plate and partitioning an interior of the outer casing to define an indoor side unit and an outdoor side unit, the outdoor side unit includes a compressor, an outdoor heat exchanger, an outdoor fan, a fan motor coupled to the outdoor fan, an outdoor inlet which opens through the outer casing on an outdoor side thereof, an outdoor outlet, and an outdoor ventilation circuit, wherein the indoor side unit includes an indoor heat exchanger, an indoor fan operably coupled with the fan motor, an indoor inlet which opens through the outer casing on an indoor side thereof, an indoor outlet, and an indoor ventilation circuit accommodating the indoor heat exchanger and the indoor fan, wherein a refrigerant cycle is constituted by the compressor, the outdoor heat exchanger, a decompression device, and the indoor heat exchanger connected to each other sequentially, and wherein said wind direction alteration device comprises:

a blade rotatably mounted about a rotary axis adapted to be disposed in the vicinity of the indoor outlet;

a wind direction alteration motor having a rotary output shaft;

a connecting rod operably connecting said rotatable blade to said wind direction alteration motor for converting rotation of said rotary output shaft to reciprocating motion of said blade about said rotary axis;

wherein an opening is formed in said connecting rod and includes a shaft-receiving opening portion;

wherein a connecting shaft is mounted to said blade and extends through said shaft-receiving opening portion;

wherein portions of said connecting shaft immediately above and below said connecting rod are larger in diameter than said shaft-receiving opening portion;

wherein said rotary output shaft of said wind direction alteration motor is in press-contact against said connecting rod, and said connecting rod is maintained in an elastically flexed condition; and wherein an inclined portion is provided on a first side of said connecting rod and has a rotary output shaft-contacting surface inclined relative to said first side of said connecting rod, said inclined portion being interposed between said connecting rod and said rotary output shaft.

2. A wind direction alteration device as defined in claim 1, wherein said opening in said connecting member is elongated and includes a shaft-insertion portion adjacent said shaft-receiving opening portion, and a constricted portion between said shaft-receiving opening portion and said shaft-insertion portion.

3. A wind direction alteration device as defined in claim 2, wherein said connecting rod includes at least three projections extending into said shaft-receiving opening portion of said opening.

4. A wind direction alteration device as defined in claim 1, wherein an elongated rotary output shaft-receiving opening is formed in said connecting rod and receive said rotary output shaft therein;

a rib is formed on an inner surface of said elongated rotary output shaft-receiving opening, said rib being parallel with a direction in which said rotary output shaft-receiving opening is elongated.

5. A wind direction alteration device for use in an integral type air conditioning apparatus comprising an outer casing, a partitioning plate mounted in the outer casing and partitioning an interior of the outer casing to define an indoor side unit and an outdoor side unit of the air conditioning apparatus, the indoor side unit including an indoor outlet, said wind direction alteration device comprising:

a blade rotatably mounted about a rotary axis adapted to be disposed in the vicinity of the indoor outlet;

a wind direction alteration motor having a rotary output shaft;

a connecting rod operably connecting said rotatable blade to said wind direction alteration motor for converting rotation of said rotary output shaft to reciprocating motion of said blade about said rotary axis;

wherein an opening is formed in said connecting rod and includes a shaft-receiving opening portion;

wherein a connecting shaft is mounted to said blade and extends through said shaft-receiving opening portion;

wherein portions of said connecting shaft immediately above and below said connecting rod are larger in diameter than said shaft-receiving opening portion;

wherein said rotary output shaft of said wind direction alteration motor is in press-contact against said connecting rod, and said connecting rod is maintained in an elastically flexed condition; and wherein an inclined portion is provided on a first side of said connecting rod and has a rotary output shaft-contacting surface inclined relative to said first side of said connecting rod, said inclined portion being interposed between said connecting rod and said rotary output shaft.

6. A wind direction alteration device as defined in claim 5, wherein said opening in said connecting rod is elongated and includes a shaft-insertion portion adjacent said shaft-receiving opening portion, and a constricted portion between said shaft-receiving opening portion and said shaft-insertion portion.

7. A wind direction alteration device as defined in claim 6, wherein said connecting rod includes at least three projections extending into said shaft-receiving opening portion of said opening.

8. A wind direction alteration device as defined in claim 6, wherein an elongated rotary output shaft-receiving opening is formed in said connecting rod and receives said rotary output shaft therein;

a rib is formed on an inner surface of said elongated rotary output shaft-receiving opening, said rib being parallel with a direction in which said rotary output shaft-receiving opening is elongated.

9. A wind direction alteration device for use in an integral type air conditioning apparatus comprising an outer casing, a partitioning plate mounted in the outer casing and partitioning an interior of the outer casing to define an indoor side unit and an outdoor side unit of the air conditioning apparatus, the indoor side unit including an indoor outlet, said wind direction alteration device comprising:

a blade rotatably mounted about a rotary axis adapted to be disposed in the vicinity of the indoor outlet;

a wind direction alteration motor having a rotary output shaft;

a connecting shaft mounted to said blade;

a connecting rod connecting said connecting shaft to said rotary output shaft, said connecting rod having an opening therein including a shaft-receiving opening portion through which said connecting shaft is disposed;

wherein portions of said connecting shaft immediately above and below said connecting rod are larger in diameter than said shaft-receiving opening portion;

wherein said rotary output shaft of said wind direction alteration motor is in press-contact against said connecting rod, and said connecting rod is maintained in an elastically flexed condition; and wherein an inclined portion is provided on a first side of said connecting rod and has a rotary output shaft-contacting surface inclined relative to said first side of said connecting rod, said inclined portion being interposed between said connecting rod and said rotary output shaft.

10. A wind direction alteration device as defined in claim 9, wherein said opening in said connecting rod is elongated and includes a shaft-insertion portion adjacent said shaft-receiving opening portion, and a constricted portion between said shaft-receiving opening portion and said shaft-insertion portion.

11. A wind direction alteration device as defined in claim 9, wherein said connecting rod includes at least three projections extending into said shaft-receiving opening portion of said opening.

12. A wind direction alteration device as defined in claim 9, wherein an elongated rotary output shaft-receiving opening is formed in said connecting rod and receives said rotary output shaft therein;

a rib is formed on an inner surface of said elongated rotary output shaft-receiving opening, said rib being parallel with a direction in which said rotary output shaft-receiving opening is elongated.

* * * * *